US006834590B2

(12) United States Patent
Naniwa

(10) Patent No.: US 6,834,590 B2
(45) Date of Patent: Dec. 28, 2004

(54) LITHOGRAPHIC PRINTING METHOD AND PRINTING PRESS

(75) Inventor: Mutsumi Naniwa, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/630,753

(22) Filed: Jul. 31, 2003

(65) Prior Publication Data

US 2004/0038153 A1 Feb. 26, 2004

(30) Foreign Application Priority Data

Aug. 22, 2002 (JP) ..... 2002-241457

(51) Int. Cl.[7] ..... B41F 31/02; B41F 33/00

(52) U.S. Cl. ..... 101/491; 101/450.1; 101/484; 101/350.1; 101/364

(58) Field of Search ..... 101/141, 142, 101/450.1, 348, 349.1, 350.1, 364, 365, 366, 367, 484, 491, 492, DIG. 45

(56) References Cited

U.S. PATENT DOCUMENTS 3,958,509 A * 5/1976 Murray et al. ..... 101/350.1
4,388,864 A * 6/1983 Warner ..... 101/148
5,073,464 A * 12/1991 Osawa et al. ..... 430/30
6,318,259 B1 * 11/2001 Chou et al. ..... 101/350.5
6,675,714 B2 * 1/2004 Furukawa ..... 101/484
6,698,353 B2 * 3/2004 Chou et al. ..... 101/349.1

FOREIGN PATENT DOCUMENTS

| | | | |
|---|---|---|---|
| EP | 0 186 620 | A2 * | 7/1986 |
| JP | 55-7453 | A | 1/1980 |
| JP | 2001-514104 | A | 9/2001 |
| WO | WO 99/11459 | | 3/1999 |

* cited by examiner

*Primary Examiner*—Leslie J. Evanisko
(74) *Attorney, Agent, or Firm*—Sughrue Mion, PLLC

(57) ABSTRACT

Disclosed is a lithographic printing method which performs lithographic printing with emulsion ink as it is supplied from an ink fountain which is a reservoir of the emulsion ink to a lithographic printing plate, comprising the steps of: computing amounts of consumption of ink and aqueous components of the emulsion ink on the basis of a percent image area of the lithographic printing plate; and replenishing the ink fountain with at least one member of the group consisting of the ink component, the aqueous component and the emulsion ink in accordance with the computed amounts of consumption of the ink and aqueous components. By the lithographic printing method of the present invention, the problems that accompany the process of lithographic printing with emulsion ink, such as scumming which results from high consumption of the aqueous component, as well as faint image density, waterlogging due to over-emulsification and the like which result from low consumption of the aqueous component can be prevented and one can produce high-quality printed matter that is free from any deterioration in image quality on account of those problems.

2 Claims, 5 Drawing Sheets

LITHOGRAPHIC PRINTING METHOD AND PRINTING PRESS

BACKGROUND OF THE PRESENT INVENTION

1. Field of the Present Invention

This invention relates to a lithographic printing method and a printing press that can be used in implementing the method.

2. Description of the Related Art

A conventionally known ink supplying apparatus that uses emulsion ink is shown in FIG. 5. Being generally indicated by 50, the apparatus comprises a form roller 52 in contact with a plate cylinder 51, an adjuster roller 53 in contact with the form roller 52, a cooling mechanism (not shown) for cooling the adjuster roller 53, an ink fountain roller 54 in contact with the form roller 52, and an ink fountain 56 provided adjacent the ink fountain roller 54 to hold emulsion ink 55 (see JP 55-7453 A (the term "JP XX-XXXXXX A" as used herein means an "unexamined published Japanese patent application") at pages 1–4 and FIG. 3).

In the illustrated ink supplying apparatus 50, the ink fountain roller 54 draws the emulsion ink 55 from the ink fountain 56 and supplies it to the form roller 52. The emulsion ink on the form roller 52 is subjected to shear stress under the nip pressure between the adjuster roller 53 and the form roller 52 while at the same time it is cooled by the cooling mechanism. As the result, the ink undergoes emulsion's disruption and separates into the ink and aqueous components. The resulting ink and aqueous components are transferred from the form roller 52 onto a lithographic printing plate Ps on the plate cylinder 51. The ink and aqueous components are then transferred from the lithographic printing plate Ps to a blanket cylinder 57 according to the image and non-image areas of the lithographic printing plate Ps. From the blanket cylinder 57, the ink and aqueous components are transferred to printing paper P as it is held between the blanket cylinder 57 and an impression cylinder 58, whereby the printing process is completed.

A problem with the above-described ink supplying apparatus is that as printing progresses, the proportion of the ink and aqueous components may vary in the ink fountain 56 and other parts, making it impossible to maintain consistent printing operations.

Specifically, if the consumption of the aqueous component is high, the concentration of the ink component will increase as printing proceeds, eventually increasing the chance for the occurrence of scumming. Conversely, if the consumption of the aqueous component is low, its concentration will increase as printing proceeds, causing such problems as lower image density and waterlogging due to over-emulsification.

In order to deal with these problems, it has been proposed that the moisture content of the emulsion ink be detected with a moisture sensor and that on the basis of the result of the detection, the emulsion ink be replenished with the ink component or the aqueous component to maintain the preferred moisture content (see JP 2001-514104 A).

However, the moisture content of the emulsion ink is difficult to measure with high precision, so it is difficult to control the emulsion ink such that it consistently has the preferred moisture content. As a further problem, the moisture sensor is expensive and contributes to a higher equipment cost.

SUMMARY OF THE PRESENT INVENTION

An object of the present invention is to provide a method of emulsion-ink based lithographic printing that can maintain predetermined a proportion of an ink component and an aqueous component so as to realize consistent printing operations at low cost, and to provide an apparatus for use in implementing the method.

The present invention provides the following lithographic printing methods (1) and printing press (2).

(1) A lithographic printing method which performs lithographic printing with emulsion ink as it is supplied from an ink fountain which is a reservoir of the emulsion ink to a lithographic printing plate, comprising the steps of:

computing amounts of consumption of ink and aqueous components of the emulsion ink on the basis of a percent image area of the lithographic printing plate; and replenishing the ink fountain with at least one member of the group consisting of the ink component, the aqueous component and the emulsion ink in accordance with the computed amounts of consumption of the ink and aqueous components.

(2) A printing press which performs printing using emulsion ink, comprising:

an emulsion ink supplier having an ink fountain which is a reservoir of the emulsion ink and a form roller which supplies the emulsion ink to a lithographic printing plate on a plate cylinder; and a replenisher having a replenishment control unit which determines amount of replenishment in which the ink fountain is to be replenished with at least one member of the group consisting of the ink component, the aqueous component and the emulsion ink in accordance with amount of consumption of each of the ink and aqueous components of the emulsion ink as computed on the basis of percent image area of the lithographic printing plate and a replenishing unit which replenishes the ink fountain with at least one member of the group consisting of the ink component, the aqueous component and the emulsion ink in accordance with the determined amount of replenishment.

According to the present invention, the problems that accompany the process of lithographic printing with emulsion ink, such as scumming which results from high consumption of the aqueous component, as well as faint image density, waterlogging due to over-emulsification and the like which result from low consumption of the aqueous component can be prevented and one can produce high-quality printed matter that is free from any deterioration in image quality on account of those problems.

DETAILED DESCRIPTION

On the following pages, the lithographic printing method and the printing press of the present invention are described in detail with reference to the preferred embodiments depicted in the accompanying drawings.

Figure 1:
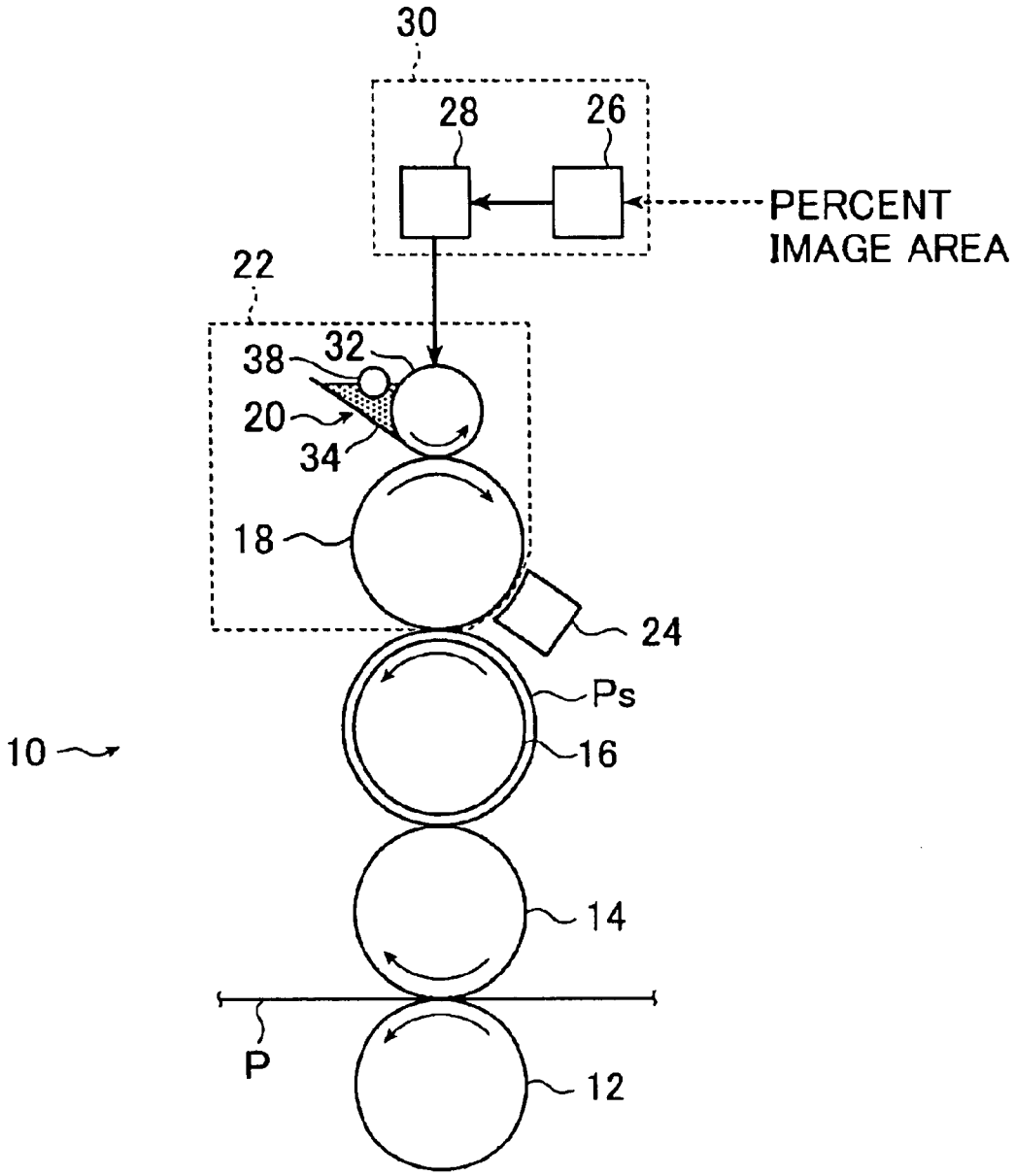
FIG. 1 shows in conceptual form an example of the printing press of the present invention.

FIG. 1 shows in conceptual form an example of the printing press of the present invention which is used to implement the lithographic printing method of the present invention.

The printing plate generally indicated by 10 in FIG. 1 comprises:

- an impression cylinder 12 and a blanket cylinder 14 which hold printing paper P;
- a plate cylinder 16 that is in contact with the blanket cylinder 14 and holds a lithographic printing plate Ps;
- an emulsion ink supplier 22 having an ink fountain 20 which is a reservoir of emulsion ink and a form roller 18 which supplies the emulsion ink to the lithographic printing plate Ps on the plate cylinder 16;
- an emulsion disrupter 24 which separates the emulsion ink into the ink and aqueous components on the form roller 18; and
- a replenisher 30 having a replenishment control unit 26 which determines amount of replenishment in which the ink fountain 20 is to be replenished with at least one member of the group consisting of the ink component, the aqueous component and the emulsion ink in accordance with amount of consumption of each of the ink and aqueous components of the emulsion ink as computed on the basis of percent image area of the lithographic printing plate Ps and a replenishing unit 28 which replenishes the ink fountain 20 with at least one member of the group consisting of the ink component, the aqueous component and the emulsion ink in accordance with the determined amount of replenishment.

In order to clarify the system configuration, the illustrated printing press 10 is assumed to perform monocolor printing. This is not the sole case of the present invention and it can be applied not only to realize a configuration corresponding to a printing press for four-color (full-color) images but also to operate a variety of multi-color printing presses using two or more color.

In the printing press 10, the impression cylinder 12, the blanket cylinder 14 and the plate cylinder 16 can be designed to have conventionally known structures.

Figure 4:
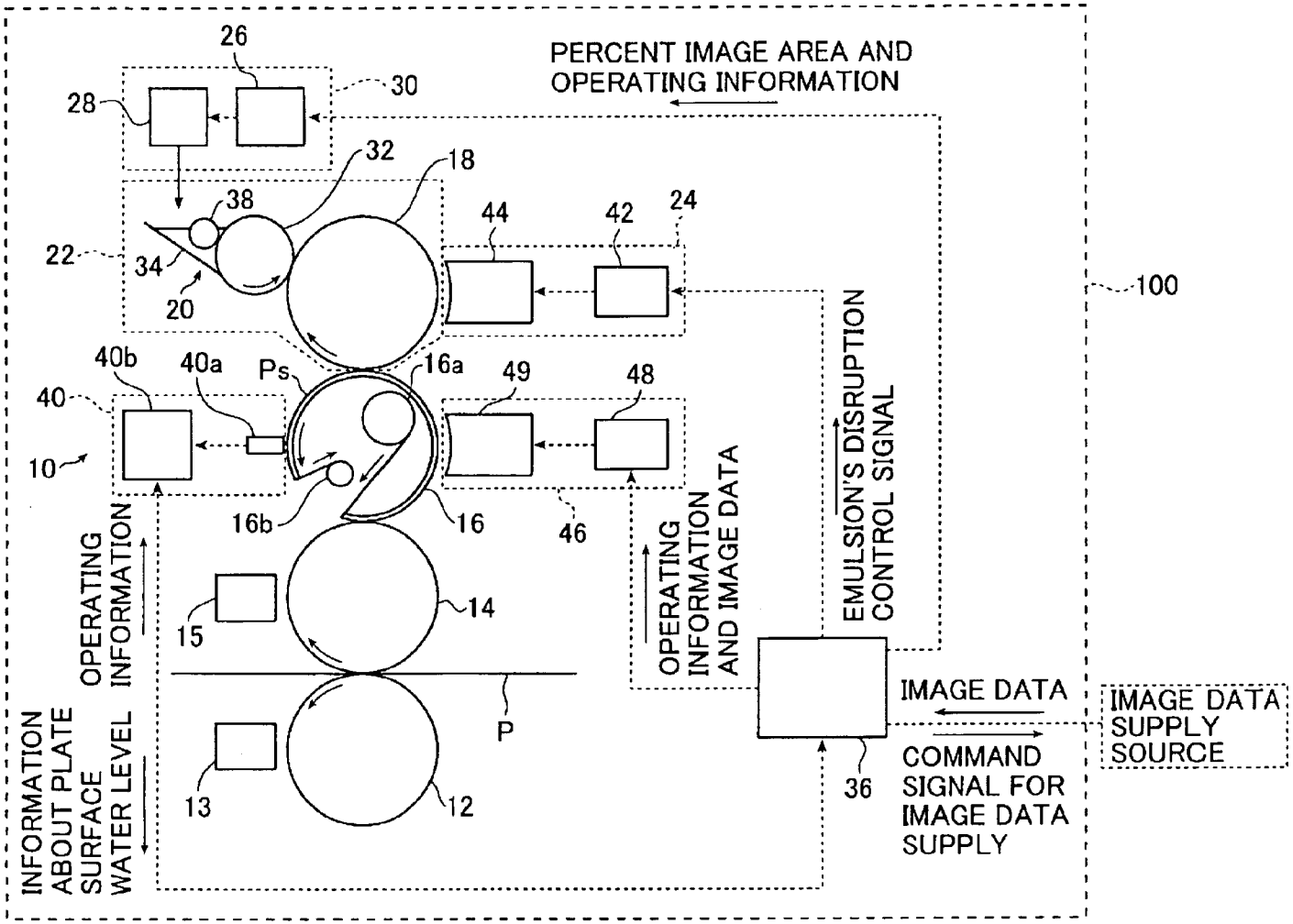
FIG. 4 shows in conceptual form an exemplary CTC system incorporating the printing press of the present invention.
Figure 5:
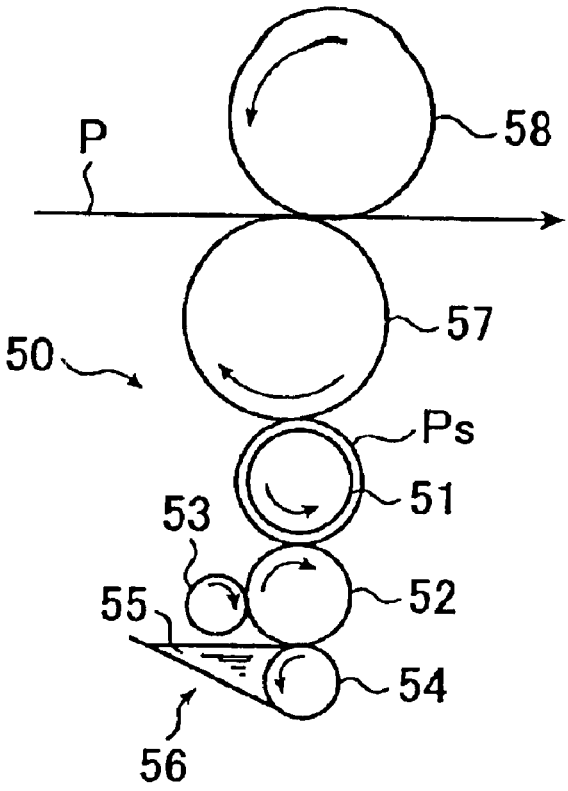
FIG. 5 PRIOR ART
FIG. 5 shows in conceptual form a conventional ink supplying apparatus that uses emulsion ink.

As shown in FIG. 4 in association with a preferred embodiment that is to be described later, the impression cylinder 12 is preferably provided with an impression cylinder washing unit 13 and the blanket cylinder 14 with a blanket cylinder washing unit 15.

The lithographic printing plate Ps that can be employed on the printing press 10 of the present invention is not limited in any particular way and all types of plates can be used as long as they form ink-receptive image areas and water-receptive non-image areas and allow for the use of emulsion ink.

Specific examples include a photopolymer type, silver salt diffusion transfer type, a silver salt/diazo complex type, thermal reaction dissolvable changing type, ablation types (simple development type/no development type), phase conversion type (simple development type/no development type), electrophotographic type, as well as a positive and a negative conventional PS plate.

In the printing press 10 of the embodiment under consideration, the emulsion ink is supplied to the lithographic printing plate Ps by the emulsion ink supplier 22 which works as an inker and has an extremely simple construction since its basic components are only the ink fountain 20, an ink fountain roller 32 and the form roller 18.

The emulsion ink supplier 22 has the ink fountain 20 which consists of the ink fountain roller 32 and a blade 34 and is basically of a known type. The ink fountain roller 32 draws a predetermined film thickness of emulsion ink (i.e., draws a metered amount of emulsion ink) out of the ink fountain 20 and transfers the drawn emulsion ink to the form roller 18 rotating in contact with the ink fountain roller 32. The form roller 18 in turn transfers the emulsion ink to the lithographic printing plate Ps which is fixed to the plate cylinder 16.

In the illustrated emulsion ink supplier 22, the film thickness of the emulsion ink (i.e., the amount of its supply) to be drawn by the ink fountain roller 32 is controlled by adjusting the gap between the tip of the blade 34 and the ink fountain roller 32.

In the printing press 10 of the present invention, the unit for drawing (metering) the emulsion ink is not limited to the illustrated example.

In one example, an anilox roller is combined with a doctor blade in such a way that as the former draws out ink, the latter scrapes the unwanted portion of the ink, thereby supplying a specified quantity of the ink. Alternatively, two rollers are provided either in mutual contact or slightly spaced apart and the pressure of contact between the two rollers or their gap and the rates at which they rotate are controlled to draw out ink in a specified film thickness.

In the illustrated emulsion ink supplier 22 capable of continuous ink supply, an aggregate of emulsion ink (so-called "ink roll") may occur within the ink fountain 20. The ink roll blocks the flow of the emulsion ink within the ink fountain 20, thereby interfering with the supply of the emulsion ink. The ink roll has the additional disadvantage of changing the balance between the ink and aqueous components to cause adverse effects on printing performance.

In order to avoid these inconveniences, the ink fountain 12 has preferably an ink agitator 38 that agitates the emulsion ink in it as shown in the illustrated case.

A variety of ink agitator may be employed. Two specific examples are an agitating roller rotating on a shaft parallel to the form roller 18 and a baffle plate, each being provided within a region of the ink fountain 20 where the ink roll will form. The agitating roller is preferably provided at a distance of 1–5 mm from the form roller 18. The baffle plate may take a variety of shapes including a plate, a prism and a cylinder. In order to improve the efficiency of agitation, the baffle plate may comprise a plurality of stages depending on the direction in which the form roller 18 rotates. If desired, the baffle plate may be divided into segments along the rotating axis of the form roller 18 that are in different positions in the direction of its rotation.

In the illustrated case, the emulsion ink supplier 22 is composed of the ink fountain 20 (comprising the ink fountain roller 32, blade 34, etc.) and the form roller 18. This is not the sole case of the present invention and the form roller as a component of the emulsion ink supplier may also serve as the ink fountain roller. In this alternative structure, the ink fountain may have an ink agitator.

The form roller 18 transfers the emulsion ink to the lithographic printing plate Ps on the plate cylinder 16 after it has been transferred from the ink fountain roller 32. The form roller 18 is not limited in any particular way and conventionally known types may be employed, including not only a roller type but also a belt type.

In order to ensure that no difference in ink density (ghost) will occur on account of uneven ink transfer, the diameter of the form roller 16 is preferably adjusted to be substantially equal to that of the plate cylinder 16.

Further referring to FIG. 1, the emulsion ink in the ink fountain 20 is drawn by the ink fountain roller 32 from the ink fountain 20 to be transferred to the form roller 18, where it has the emulsion disrupted by the emulsion disruptor 24 so that it is at least partly separated into the ink and aqueous components. Thereafter, the emulsion ink is transferred from the form roller 18 to the lithographic printing plate Ps wrapped around the plate cylinder 16, from which it is further transferred to the blanket cylinder 14. The emulsion ink on the blanket cylinder 14 which has been separated into the ink and aqueous components is transferred onto a substrate P (e.g., printing paper) as it is transported through the nip between the blanket cylinder 14 and the impression cylinder 12, thus producing printed matter.

In the present invention, the emulsion ink is not limited in any particular way and a variety of types may be employed. Preferred examples are specifically shown in JP 49-26844 B (the term "JP XX-XXXXXX B" as used herein means an "examined Japanese patent publication"), JP 49-27124 B, JP 49-27125 B, JP 61-52867 B, JP 53-27803 A, JP 53-29807 A, JP 53-36307 A, JP 53-36308 A, JP 54-106305 A; JP 54-146110 A, JP 57-212274 A, JP 58-37069 A, JP 58-211484 A, etc.

In the present invention, the emulsion ink is only required to be such that the ink and aqueous components are in the state of an emulsion within the ink fountain 20 and they do not necessarily have to be supplied as an emulsion ink into the ink fountain 20.

As will be described later, the illustrated printing press 10 uses the ink replenisher 30 to supply the ink fountain 20 with at least one member of the group consisting of the ink component, the aqueous component and the emulsion ink. In the illustrated printing press 10 which performs continuous ink supply, even if the ink fountain 20 is replenished with the ink component and the aqueous component as separate entities, sufficient agitation occurs within the ink fountain 20 to disperse the two components in a state of emulsion, thereby forming emulsion ink.

The emulsion ink may be of an oil-in-water type (O/W type) or a water-in-oil type (W/O type). For the purposes of the present invention, emulsion ink of W/O type is preferred.

The aqueous component of the W/O type emulsion ink can be easily separated out by application of shear stress. Therefore, by employing the printing press 10 of the present invention which has the emulsion disrupter 24 that separates the emulsion ink into the aqueous and ink components on the form roller 18, preferably the emulsion disrupter 24 that applies shear stress to the emulsion ink, the separated aqueous component can be sufficiently supplied to the non-image areas of the lithographic printing plate Ps so that consistent printing operations can be realized.

In the illustrated case, the ink fountain 20 is replenished by the replenisher 30 having the replenishing unit 28 and the replenishment control unit 26.

Specifically, at first, the replenishment control unit 26 computes the amounts of consumption of the ink and aqueous components of the emulsion ink on the basis of the percent image area of the lithographic printing plate Ps. Of course, the amounts of consumption may be computed by another unit than the replenishment control unit 26.

The percent image area means the extent of the image areas relative to the overall area of the lithographic printing plate and may be exemplified by a value that is computed by dividing the total area of the dots in the image areas by the overall area of the lithographic printing plate. One way to compute the percent image area is from image data obtained by DTP (desktop publishing), a plate setter, a percent graphics area meter, etc. The percent graphics area meter to be employed may be of any conventionally known type.

In the next step, the replenishment control unit 26 determines the amount of replenishment in which the ink fountain 20 is to be replenished with at least one member of the group consisting of the ink component, the aqueous component and the emulsion ink in accordance with the computed amounts of consumption of the ink and aqueous components of the emulsion ink.

Further, the replenishing unit 28 replenishes the ink fountain 20 with at least one member of the group consisting of the ink component, the aqueous component and the emulsion ink in accordance with the determined amount of replenishment. As a result, the proportion of the ink and aqueous components of the emulsion ink in the ink fountain is maintained at predetermined levels.

For replenishment, a variety of methods can be employed. In order to ensure that the proportion of the ink and aqueous components of the emulsion ink in the ink fountain 20 is maintained at predetermined levels, the ink component and/or the aqueous component may be supplied in amounts that are equal to the amounts of consumption of those components (The ink fountain 20 could be replenished with the emulsion ink by determining the amounts of its ink and aqueous components separately; the same holds true in the following description).

Another way to replenish the ink fountain is by determining the amounts of consumption of the ink and aqueous components per print, correcting those amounts on the basis of information such as the operating information for the printing press 10 (e.g., run and stop, and print speed) and the amount of evaporation, thereby determining the corrected amounts of consumption of the ink and aqueous components.

Figure 2:
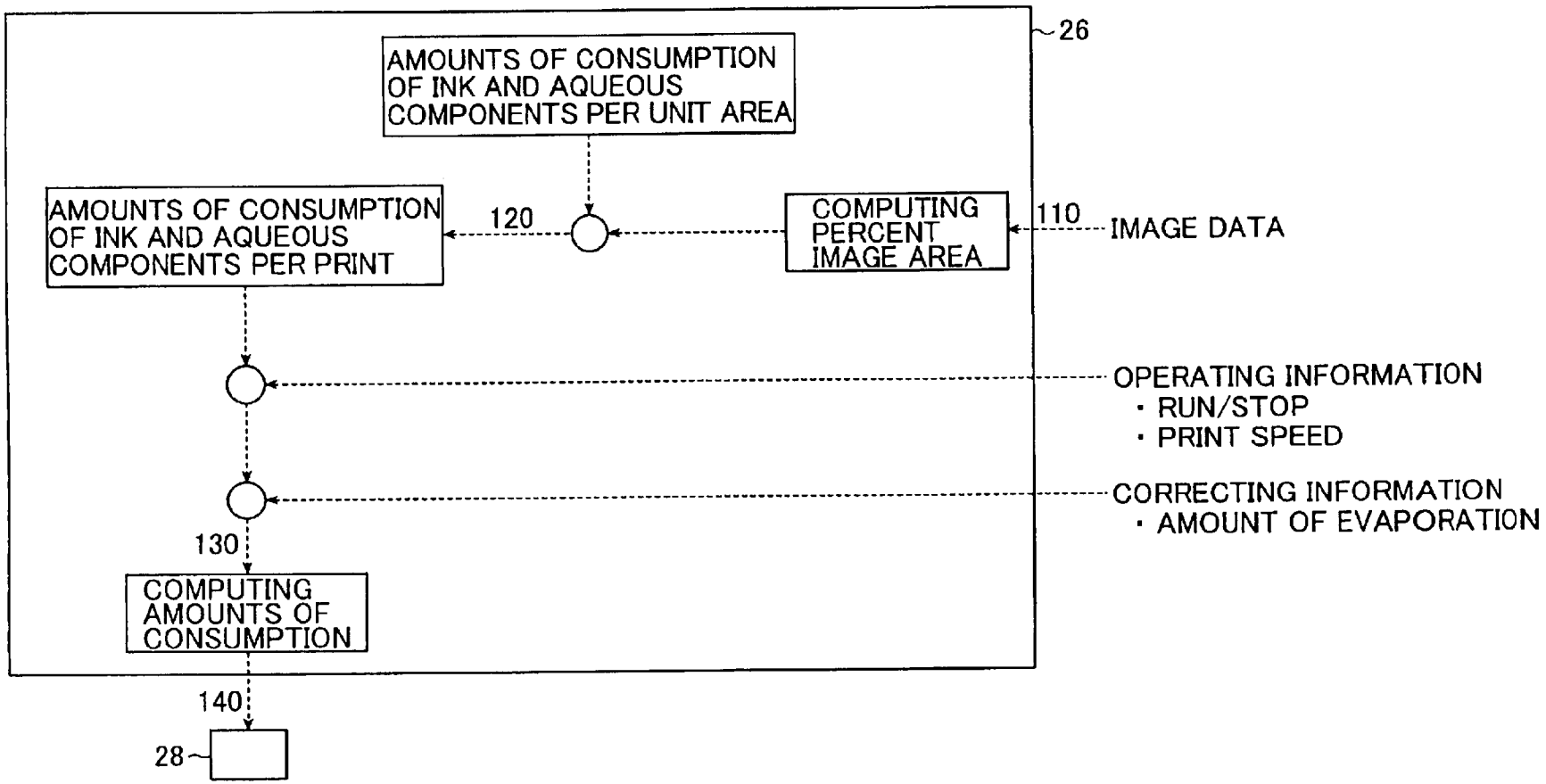
FIG. 2 shows in conceptual form an example of the replenishment control unit.

FIG. 2 shows in conceptual form an example of the replenishment control unit 26.

The replenishment control unit 26 computes the percent image area from the image data it received (step 110). The percent image area may be computed by another unit. On the basis of the percent image area and the amounts of consumption of the ink and aqueous components per unit area, the replenishment control unit 26 computes the amounts of consumption of the ink and aqueous components per print (step 120). Further, on the basis of the amounts of consumption of the ink and aqueous components per print, as well as the operating information (e.g., run and stop, and print speed) and the correcting information (e.g., the amounts of evaporation of the ink and aqueous components), the replenishment control unit 26 computes the amounts of consumption of the ink and aqueous components in the ink fountain 20 to determine the required amounts of replenishment (step 130). Further, on the basis of the thus determined amounts of replenishment, the replenishment control unit 26 sends an instruction to the replenishing unit 28 (step 140).

Figure 3A:
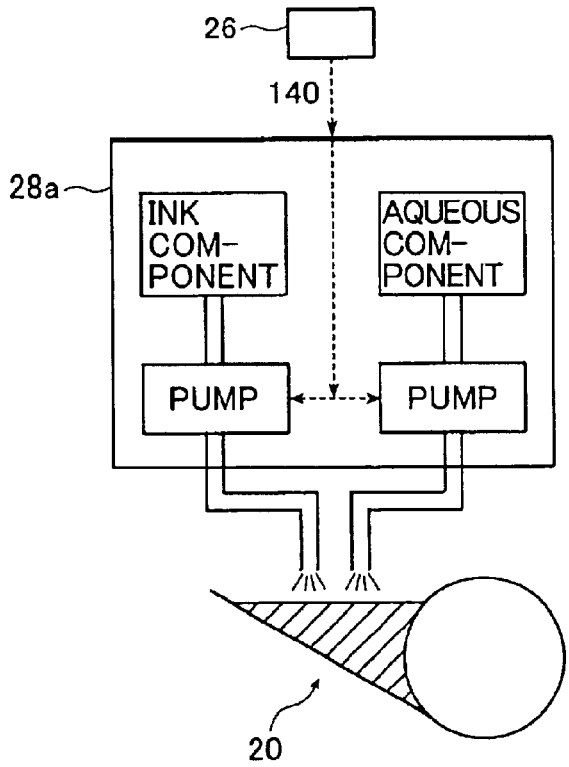
FIG. 3A shows in conceptual form an example of the replenishing unit which performs replenishment with the ink component and the aqueous component.
Figure 3B:
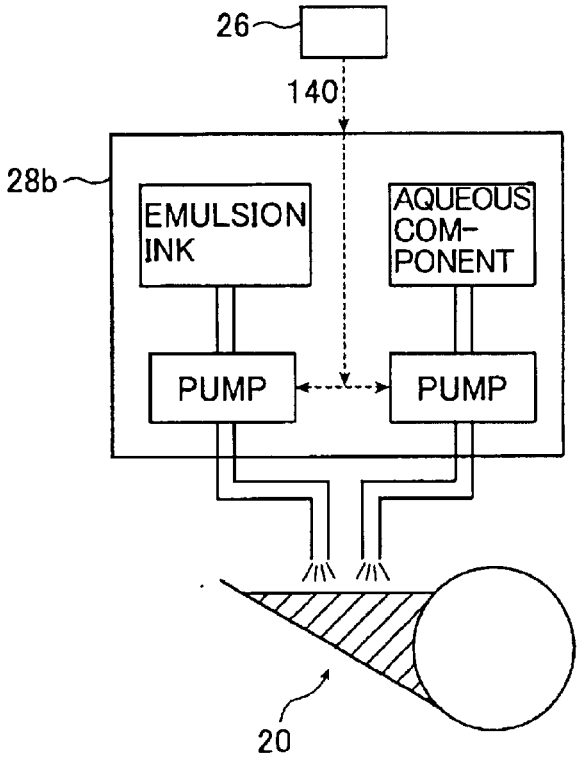
FIG. 3B shows in conceptual form another example of the replenishing unit which performs replenishment with the emulsion ink and the aqueous component.

FIGS. 3A and 3B show in conceptual form two examples of the replenishing unit 28.

A replenishing unit 28*a* shown in FIG. 3A has two tanks, one as a reservoir of the ink component and the other as a reservoir of the aqueous component, and each tank is equipped with a pump. A replenishing unit 28*b* shown in FIG. 3B also has two tanks, one as a reservoir of the emulsion ink and the other as a reservoir of the aqueous component, and each tank is equipped with a pump.

In the replenishing unit 28, a pump or pumps are driven in response to the instruction sent from the replenishment control unit 26 so that the ink fountain 20 is replenished with at least one member of the group consisting of the ink component, the aqueous component and the emulsion ink. Referring to the replenishing unit 28*a* shown in FIG. 3A, the ink fountain 20 is replenished with the ink and aqueous components from the associated tanks. In the replenishing unit 28*b* shown in FIG. 3B, the ink fountain 20 is replenished with the emulsion ink and the aqueous component from the associated tanks.

Although not shown, the replenishing unit may be of a type that replenishes the ink fountain with the emulsion ink and the ink component or it may be of a type that replenishes the ink fountain with the emulsion ink, the ink component and the aqueous component.

Alternatively, the replenishing unit may be of a type that replenishes the ink fountain with either the emulsion ink or the ink component or the aqueous component. For instance, the replenishing unit may be of such a type that the proportion of the ink and aqueous components is appropriately adjusted for an image so as to formulate an emulsion ink in which the two components are dispersed and with which the ink fountain 20 is replenished. In another example, multiple kinds of emulsion ink are preliminarily provided at different proportions of the ink and aqueous components and the ink fountain 20 is replenished with a selected emulsion ink that is appropriate for an image. In yet another example, the ink fountain 20 may be replenished with an emulsion ink having a constant proportion of the ink and aqueous components.

Thus, in the present invention, a variety of methods may be employed to replenish the printing press 10 with ink as long as they can supply the emulsion ink to the form roller 18.

Replenishment may be performed with the amounts of replenishment being fixed for either unit time (continuous method) or a specified time interval (intermittent method). The replenishing unit may replenish the ink fountain 20 with the respective components by any known methods including the aforementioned use of pumps.

Thus, as noted above, the ink fountain 20 is replenished with at least one member of the group consisting of the ink component, the aqueous component and the emulsion ink in accordance with the amounts of consumption of the ink and aqueous components and, as a result, the proportion of the ink and aqueous components of the emulsion ink in the ink fountain 20 is maintained at predetermined levels.

In consequence, consistent printing can be realized at low cost. Specifically, scumming that results from high consumption of the aqueous component, or faint image density, waterlogging due to over-emulsification and the like that result from low consumption of the aqueous component can be prevented and one can obtain high-quality printed matter that is free from deterioration in image quality on account of those problems.

For the purposes of the present invention, the ink and aqueous components of the emulsion ink in the ink fountain 20 may be maintained at predetermined proportion which specifically are within ranges that do not cause problems including scumming, faint image density and waterlogging due to over-emulsification.

As described on the foregoing pages, the printing press 10 of the present invention employs emulsion ink.

However, with printing presses that use emulsion ink, it sometimes occurs that the ink and aqueous components do not separate out on the plate surface and thus fail to adhere to the image and non-image areas in an appropriate way. Thus, the printing press 10 of the present invention has the emulsion disruptor 24 which causes at least part of the emulsion ink on the form roller 18 to be separated into the ink and aqueous components. On the pages that follow, the separation of the emulsion ink into the ink and aqueous components may also be referred to as "emulsion's disruption".

The emulsion disrupter 24 effects emulsion's disruption of the emulsion ink on the form roller 18.

The construction of the emulsion disruptor 24 is not limited in any particular way and a variety of conventionally known devices may be employed. It may be exemplified by emulsion disrupter by which the emulsion adhering to the form roller 18 is given sufficient shear stress to disrupt the emulsion. Specifically, a preferred example is a roller which, while making contact with the form roller 18, rotates either in the same direction or in opposite direction to a rotation direction of the form roller 18 at the point of contact. This roller slips at the point of contact with the form roller 18, thereby imparting sufficient shear stress to the emulsion ink to disrupt the emulsion.

Another exemplary emulsion disrupter is such that shear stress is applied by contact pressure (or nip pressure) to disrupt the emulsion. Specifically, a preferred example is a roller that contacts the form roller 18 and which, through control of the width of contact (or the width of nip) with the form roller 18, applies contact pressure (or nip pressure), whereby sufficient shear stress is exerted on the emulsion ink to disrupt the emulsion.

In order to achieve more efficient emulsion's disruption, the above-described emulsion disrupter for applying shear stress may be combined with the cooler of cooling ink which is exemplified in JP 53-36308 A, etc.

The cooler alone may be employed as the emulsion disrupter. In this case, too, the degree of emulsion's disruption can be controlled by adjusting the cooling temperature. Generally speaking, the emulsion's disruption is promoted with decreasing temperature. The cooling temperature is set at a higher temperature than the freezing point of the emulsion ink.

In the printing press of the present invention, the amount of emulsion's disruption by the emulsion disrupter may be constant.

However, one may provide a controller for controlling the amount of emulsion's disruption and make appropriate adjustments of the amount of emulsion's disruption on the form roller 18. By so doing, the ink and aqueous components can be adjusted to have a good balance suitable for printing.

If the illustrated printing press 10 is compatible with a CTC (computer-to-cylinder) system, the percent image area of the lithographic printing plate can be calculated from image data before printing operations start. The term CTC refers to a system in which an image created by computer or the like is recorded direct on a plate fixed to the plate cylinder in a printing press to make a lithographic printing plate (this platemaking process is commonly called "on press CTP") and printing is performed using the thus made plate. The CTC system has already been commercialized as a system for realizing an efficient printing process.

FIG. 4 shows in conceptual form an example of a CTC system that incorporates the printing press 10 and which is generally indicated by 100.

In the printing press 10 shown in FIG. 4, an image former 46 forms a printing image (an image having ink-receptivity in areas corresponding to image areas of a print and water-receptivity in areas corresponding to non-image areas of a print) on a plate fixed to the plate cylinder 16 so as to provide a lithographic printing plate Ps and printing is performed with the emulsion ink in the ink fountain 20 being transferred by the emulsion ink supplier 22 onto the lithographic printing plate Ps via the form roller 18.

In a more preferred embodiment, the replenishment control unit 26 in the replenisher 30 computes the amounts of consumption of the ink and aqueous components using the data of the percent image area from a main control unit 36 as a principal parameter. In addition, in accordance with the computed amounts of consumption, and the operating information and the like supplied from the main control unit 36, the replenishment control unit 26 determines the amounts of replenishment with the ink and aqueous components and sends the necessary instruction to the replenishing unit 28.

The replenishing unit 28 replenishes the ink fountain 20 with the ink and aqueous components in the amounts of replenishment as instructed by the replenishment control unit 26.

The percent image area is not the only parameter that can be used to determine the amounts of consumption of the ink and aqueous components and other useful parameters include the amount of consumption of the aqueous component per unit area in the non-image areas and the amount of consumption of the emulsion ink per unit area in the image areas (i.e., the amounts of consumption of the ink and aqueous components contained in the emulsion ink deposited in the image areas).

These parameters vary somewhat with the emulsion ink, the plate, printing paper, etc. that are used, so one may preliminarily provide the main control unit 36 with a table that determines the specific value of a parameter in view of the combination of the emulsion ink, plate and printing paper.

The operating information supplied from the main control unit 36 may be exemplified by the operating state of the printing press, the printing speed, the number of prints and various kinds of information for correcting the amount of evaporation of the aqueous component. Among various kinds of information for correcting the amount of evaporation of the aqueous component are included the room temperature, the temperatures of the respective rollers, and the humidity.

In the printing press 10 shown in FIG. 4, the emulsion disrupter 24 has basically a plate surface water level measuring unit 40, an emulsion's disruption control unit 42 and an emulsion disrupting unit 44. The operations of these units are controlled by the main control unit 36.

The plate surface water level measuring unit 40 measures the amount of water on the lithographic printing plate fixed to the plate cylinder (which is simply referred to as the plate surface water level). It is a known device for measuring the amount of water and consists of a sensor 40*a* and a calculating section 40*b*. In the illustrated case, the calculating section 40*b* computes the plate surface water level using the result of measurement by the sensor 40*a* and the obtained information about the plate surface water level is sent to the main control unit 36.

In response to the information about the plate surface water level which has been sent from the plate surface water level measuring unit 40, the main control unit 36 determines the amount of emulsion's disruption and sends an instruction to the emulsion's disruption control unit 42. In response to this instruction, the emulsion's disruption control unit 42 drives the emulsion disrupting unit 44 such as to realize the amount of emulsion's disruption that has been determined by the main control unit 36. Specifically, for example, if the plate surface water level is low in the case of using a W/O type emulsion ink, emulsion's disruption is effected sufficiently strong that an adequate amount of the aqueous component is supplied to the plate surface. Conversely, if the plate surface water level is unduly high, weak emulsion's disruption is effected to reduce the amount of the aqueous component on the plate surface.

The emulsion disrupting unit 44 effects emulsion's disruption of the emulsion ink on the form roller 18. The specific construction of the emulsion disrupting unit 44 is essentially the same as explained in connection with the emulsion disruptor 24 shown in FIG. 1.

For the emulsion's disruption, the amount of emulsion's disruption can be controlled by adjusting the nip pressure or the rotating speeds of rollers. The emulsion disrupting unit 44 has a controller for controlling the amount of emulsion's disruption by such methods and, in response to an instruction from the main control unit 36, the emulsion's disruption control unit 42 adjusts the emulsion disrupting unit 44 for controlling the degree of emulsion's disruption.

As shown by the illustrated case, the printing press of the present invention has a detector for detecting the plate surface water level and this enables checking to see the balance between the ink and aqueous components during printing. By adjusting the amount of emulsion's disruption on the basis of this check, one can adjust for an even better balance between the ink and aqueous components that is more suitable for printing.

In the illustrated case, the plate surface water level is measured. However, this is not the sole case of the present invention and what is to be measured on the surface of the lithographic printing plate may be the amount of the ink component, the amount of the emulsion ink, the amounts of the ink and aqueous components, or the amounts of the ink component, the aqueous component and the emulsion ink. On the basis of these+, a variety of controls may be performed including the aforementioned control of the amount of emulsion's disruption.

The plate cylinder 16 retains the lithographic printing plate Ps in position on its peripheral surface and, in the illustrated case, it serves as a feeder of a yet-to-be exposed PS plate and an ejector of a used lithographic printing plate as well (i.e., a feeder/ejector).

In the illustrated case, the plate cylinder 16 has an axial access slot formed in the lateral side to provide an access for both a PS plate and a used lithographic printing plate. In the interior of the plate cylinder 16, two positions are set, one for loading a PS plate roll 16*a* of a web of PS plate and the other for loading a takeup roll 16*b* onto which the used lithographic printing plate is rewound. Also provided within the plate cylinder 16 is a drive source (not shown) for turning the takeup roll 16*b* to accumulate the used lithographic printing plate.

The PS plate roll 16*a* and the takeup roll 16*b* are so loaded that a PS plate being unwound from the PS plate roll 16*a* comes out through the access slot to be wrapped around the plate cylinder 16 under some tension and the PS plate makes reentry into it through the access slot to be rewound onto the takeup roll 16*b*.

Therefore, by rewinding the used lithographic printing plate onto the takeup roll 16*b*, one can simultaneously unwind the yet-to-be exposed PS plate from the roll 16*a* and fix it onto the plate cylinder 16.

In the present invention, the feeder/ejector is not limited to the illustrated example and a variety of methods employed in printing presses and CTC technology may be adopted.

One such example is described in JP 10-323963 A and it is a feeder/ejector which is so designed that a predetermined length of PS plate is unrolled from a PS plate roll, cut with a cutter, supplied onto the plate cylinder and fixed to it, with the used lithographic printing plate being stripped from the plate cylinder with fingers and ejected from it with a roller pair. Another example is described in JP 2000-211100 A and it is a feeder/ejector which is so designed that a cut sheet of yet-to-be exposed PS plate is placed in a cassette and loaded in a predetermined position, and thereafter supplied onto the plate cylinder, fixed to it and ejected from it using rollers, guides, etc.

In whichever case, any known methods may be employed to supply a PS plate onto the plate cylinder, fix it to the cylinder and eject a used lithographic printing plate from the latter.

In the illustrated printing press 10, lithographic printing plates are fed and ejected simultaneously by unrolling and rewinding a PS plate within the plate cylinder 16. Hence, it is preferred to use PS plates that are comparatively low in rigidity and strength. In this case, the plate cylinder 16 is preferably provided with an anti-misregister unit in order to ensure that the lithographic printing plate Ps will not stretch or experience misregister during printing.

An anti-misregister method is not limited in any particular way and a variety of known methods may be employed. One example is by graining the surface of the plate cylinder 16. Another example is the use of a under-plate sheet which has been grained at least on the surface that contacts a PS plate.

The image former 46 performs image recording on the PS plate fixed to the plate cylinder 16 so that a printing image is formed to prepare a lithographic printing plate Ps. The image former 46 comprises an image formation control unit 48 and an image forming unit 49.

In the illustrated printing press 10, the main control unit 36 issues a command signal for supplying image data and in response to this signal, an image data supply source such as DTP sends the image data for the printing image to the main control unit 36. Having received the image data, the main control unit 36 sends the image data and the operating information to the image formation control unit 48.

In response to the image data and the operating information that have been sent from the main control unit 36, the image formation control unit 48 accordingly drives the image forming unit 49.

The image forming unit 49 forms a printing image by performing image recording and other processing that is adapted for the PS plate to prepare a lithographic printing plate Ps. The image forming unit 49 has an image drawing unit adapted for the PS plate.

Specific examples of image drawing units include exposure by scanning with light beams such as laser modulated with the image to be recorded, direct imagewise heating with a thermal record head, and imagewise exposure using the combination of a light source such as a xenon lamp or an infrared lamp adapted for the spectral sensitivity characteristics of the plate and a spatial light modulator such as a liquid-crystal shutter array or DMD (digital micromirror device)™. If necessary, the image forming unit 49 may further have a developing unit which develops the plate that has image recorded by those image drawing units. The developing unit may adopt any known method that is adapted for the PS plate.

It may be possible to employ a platemaker that prepares a lithographic printing plate by having a PS plate solely consisting of non-image areas (water-receptive throughout) record an ink-receptive image by an image recording unit such as ink jet to form a printing image or a platemaker that prepares a lithographic printing plate by having a PS plate solely consisting of image areas (ink-receptive throughout) record a water-receptive image by ink jet or the like to form a printing image.

In the illustrated case, the image forming unit 49 is adapted for handling PS plates of phase conversion type and prepares lithographic printing plates by exposing them with infrared laser light modulated with the image to be recorded.

The image forming unit 49 can form a two-dimensional printing image on a yet-to-be exposed PS plate that is fixed to the plate cylinder 16 as it is rotated (i.e., scanned) at a predetermined speed adjusted for platemaking.

During the formation of a printing image (and during the rewinding of the used lithographic printing plate), the form roller 18 and the blanket cylinder 14 are preferably spaced from the plate cylinder 16. Spacing may be realized by moving either the form roller 18 or the plate cylinder 16 or both.

The main control unit 36 controls all aspects of the operation of the CTC system 100, the operation including the generation and supply of the aforementioned signal for controlling emulsion's disruption, the reception of image data from the external image data supply source, and the like. Further, on the basis of the results of detection with a variety of sensors provided at various sites in the CTC system 100, the main control unit 36 supplies the operating information to the replenishment control unit 26, emulsion's disruption control unit 42, plate surface water level measuring unit 40 (in particular, calculating section 40*b*), etc.

In the case of a CTC system that performs four-color (full-color) printing, the main control unit 36 may perform various kinds of processing on the image data supplied from the external image data supply source, including image processing such as color/density correction, and separation of a color image into monochromatic C (cyan), M (magenta), Y (yellow) and K (black) images.

Sensors to be provided at various sites in the CTC system 100 are those sensors which are usually installed in platemaking apparatuses, printing presses or on press CTP type printing presses. Examples include sensors for detecting the rotation of individual cylinders, a sensor for detecting the rotating position (phase) of the plate cylinder 16, sensors for detecting the temperatures at various parts of the system, and sensors for detecting environmental conditions such as temperature and humidity.

The operating information may specifically be illustrated by, for example, the rotating speed of the plate cylinder 16, the number of prints, the operating state of the printing press and the rotating position of the plate cylinder 16.

We now describe the action of the CTC system 100 as it includes the main control unit 36.

In the first place, the feeder/ejector in the plate cylinder 16 is actuated so that the used lithographic printing plate is rewound by the takeup roll 16*b* while at the same a yet-to-be exposed PS plate is fed so that it is fixed to the plate cylinder 16.

In parallel with these actions, the external image supply source sends the image data for the printing image to the main control unit 36 in response to the command signal for image data supply which it received from the main control unit 36.

The main control unit 36 sends the supplied image data to the image formation control unit 48 after adding information necessary for image recording. In parallel with this action, the main control unit 36 computes the percent image area from the image data and sends it to the replenishment control unit 26 together with any other parameters that are necessary for computing the amounts of consumption of the ink and aqueous components.

The replenishment control unit 26 computes the amounts of consumption of the ink and aqueous components using a variety of parameters including the percent image area.

Subsequently, the main control unit 36 causes the plate cylinder 16 to rotate at a predetermined speed adjusted for platemaking. Further, in synchronism with this rotation of the plate cylinder 16 and in accordance with the operating information being supplied from the main control unit 36 (e.g., the rotating speed of the plate cylinder 16 and its rotating position (phase)), the image formation control unit 48 drives the image forming unit 49 and in the manner already described above, a printing image is formed on the PS plate fixed to the plate cylinder 16, whereby a lithographic printing plate Ps is completed.

Upon completion of the lithographic printing plate Ps, the printing process is started. Note that the ink fountain 20 has been charged with a predetermined amount of emulsion ink containing a predetermined proportion of the ink and aqueous components.

The main control unit 36 starts the turning of all necessary parts ranging from the ink fountain roller 32 to the plate cylinder 12 so that the emulsion ink is supplied to the lithographic printing plate Ps. The main control unit 36 also drives the emulsion disrupting unit 44 and synchronously supplies printing paper P from a paper feeder (not shown) so that it is transported through the nip between the blanket cylinder 14 and the impression cylinder 12 to start printing (proofing at first) on the prepared lithographic plate Ps. The resulting printed matter is ejected in a predetermined position by a paper ejector.

In the printing press 10 of the present invention, the paper feeder and ejector may be of any known types that are employed in a variety of printing presses.

During printing, the replenishment control unit 26 determines the amounts of replenishment with the ink and aqueous components on the basis of the operating information supplied from the main control unit 36 (e.g., the operating speed of the plate cylinder 16, the number of prints, the temperatures at various parts of the system, and environmental conditions (temperature/humidity)) and the computed amounts of consumption. The replenishment control unit 26 then issues such an instruction to the ink replenishing unit 28 that it replenishes the ink fountain 20 with at least one member selected from the group consisting of the ink component, the aqueous component and the emulsion ink in quantities equal to the determined amounts of replenishment.

During printing, the amount of water on the surface of the printing plate (plate surface water level) is also measured with the surface water level measuring unit 40 and input to the main control unit 36. In view of the received plate surface water level, the main control unit 36 checks if the amount of the aqueous component on the plate surface is appropriate or not and, depending on the result of this check, computes the amount of emulsion's disruption and inputs it to the disruption control unit 42. The disruption control unit 42 accordingly adjusts the amount of emulsion's disruption which is to be effected by the emulsion disrupting unit 44. To be more specific, in the case of using a W/O type emulsion ink, if the plate surface water level is appropriate, the amount of emulsion's disruption is maintained; if the aqueous component is excessive, the amount of emulsion's disruption is reduced; and if the aqueous component is low, the amount of emulsion's disruption is increased.

While the lithographic printing method and the printing press of the present invention have been described above in detail, the present invention is by no means limited to the foregoing particular embodiment and various modifications and improvements can be made without departing from the scope and spirit of the present invention.

For example, although the printing press 10 shown in FIG. 1 has both the ink fountain roller 32 and the form roller 18 in the emulsion ink supplier 22, this is not the sole case of the present invention and a structure in which the ink fountain roller serves as the form roller is also preferred. In other words, only one roller may be used in the emulsion ink supplier.

This alternative structure is advantageous from the viewpoints of cost and structural simplicity. On the other hand, the structure depicted in FIG. 1 is advantageous from the viewpoints of stability and controllability of the amount of the emulsion ink to be supplied to lithographic printing plates. Therefore, either structure may be chosen as appropriate for various factors including the performance required of the printing press, cost and the characteristics of the emulsion ink used.

The printing press 10 depicted in FIG. 1 adopts a preferred embodiment in which its structure is simplified by using only two rollers, ink fountain roller 32 and form roller 18, in the emulsion ink supplier 22. This again is not the sole case of the present invention and one or more ink distributing rollers may be set between the ink fountain roller and the form roller.

The foregoing embodiments refer to the case of wrapping the lithographic printing plate Ps around the plate cylinder 22. This is not the sole case of the present invention and its concept may also be applied to the case of forming an image on the surface of the plate cylinder (which is generally called "plate-less printing", or a printing method in which the surface of the plate cylinder is allowed to function as a lithographic printing plate).

This application claims priority on Japanese patent application No.2002-241457, the contents of which are hereby incorporated by reference. In addition, the contents of literatures cited herein are incorporated by reference.

What is claimed is:

1. A lithographic printing method which performs lithographic printing with emulsion ink as the emulsion ink is supplied from an ink fountain which is a reservoir of the emulsion ink to a lithographic printing plate, comprising the steps of:

computing amounts of consumption of ink and aqueous components of the emulsion ink on the basis of a percent image area of the lithographic printing plate; and replenishing the ink fountain with at least one member of the group consisting of the ink component, the aqueous component and the emulsion ink in accordance with the computed amounts of consumption of the ink and aqueous components.

2. A printing press which performs printing using emulsion ink having an ink component and an aqueous component, comprising:

an emulsion ink supplier having an ink fountain which is a reservoir of the emulsion ink and a form roller which supplies the emulsion ink to a lithographic printing plate on a plate cylinder; and a replenisher having a replenishment control unit which determines amount of replenishment in which the ink fountain is to be replenished with at least one member of the group consisting of the ink component, the aqueous component and the emulsion ink in accordance with amount of consumption of each of the ink and aqueous components of the emulsion ink as computed on the basis of percent image area of the lithographic printing plate and a replenishing unit which replenishes the ink fountain with at least one member of the group consisting of the ink component, the aqueous component and the emulsion ink in accordance with the determined amount of replenishment.

* * * * *